US007975858B2

(12) United States Patent
Schneider

(10) Patent No.: US 7,975,858 B2
(45) Date of Patent: Jul. 12, 2011

(54) PRODUCT DISPLAY SHELF WITH COMPLIANT MEMBER

(75) Inventor: Raymond Schneider, Port Washington, NY (US)

(73) Assignee: Display Technologies, College Point, NY (US)

( * ) Notice: Subject to any disclaimer, the term of this patent is extended or adjusted under 35 U.S.C. 154(b) by 500 days.

(21) Appl. No.: 12/106,648

(22) Filed: Apr. 21, 2008

(65) Prior Publication Data

US 2008/0257226 A1 Oct. 23, 2008

Related U.S. Application Data

(60) Provisional application No. 60/925,406, filed on Apr. 20, 2007.

(51) Int. Cl.
*A47G 73/00* (2006.01)

(52) U.S. Cl. ..... 211/75

(58) Field of Classification Search ..... 211/74, 211/75, 87.01, 90.01, 183; 248/683, 205.5, 248/206.3, 467, 309.3; 40/597; 206/829
See application file for complete search history.

(56) References Cited

U.S. PATENT DOCUMENTS 104,787 A * 6/1870 Snow ..... 248/113
350,523 A * 10/1886 Bodley ..... 211/65
1,299,575 A * 4/1919 Holmes ..... 248/113
1,483,035 A * 2/1924 Wyatt ..... 211/65
2,491,652 A * 12/1949 Feerick ..... 211/71.01
2,695,105 A * 11/1954 Mitchell ..... 211/35
3,391,891 A * 7/1968 Garden ..... 248/311.2
3,429,542 A * 2/1969 Fagan ..... 248/313
4,286,717 A * 9/1981 Liesinger ..... 211/70.6
4,560,072 A * 12/1985 Burrell ..... 211/75
4,828,211 A * 5/1989 McConnell et al. ..... 248/311.2
4,899,895 A * 2/1990 Espasandin et al. ..... 211/85.18
5,096,272 A * 3/1992 Belokin et al. ..... 312/129
5,613,614 A * 3/1997 Richardson ..... 211/89.01
6,510,953 B2 * 1/2003 Daniels ..... 211/60.1
7,004,334 B2 * 2/2006 Walsh et al. ..... 211/88.01
7,306,106 B2 * 12/2007 Robertson ..... 211/75
7,556,159 B2 * 7/2009 Robertson ..... 211/75
2006/0102570 A1 * 5/2006 Robertson ..... 211/75
2006/0102572 A1 * 5/2006 Robertson ..... 211/75
2008/0041803 A1 * 2/2008 Robertson ..... 211/75
2009/0084739 A1 * 4/2009 Shock et al. ..... 211/4

* cited by examiner

*Primary Examiner* — Jennifer E. Novosad
(74) *Attorney, Agent, or Firm* — Carter, DeLuca, Farrell & Schmidt, LLP

(57) ABSTRACT

A product display shelf comprising a bottom surface, a rear surface and at least one compliant member is disclosed. The bottom surface is configured to support at least one product thereon. The rear surface extends upwardly from the bottom surface. The at least one compliant member is disposed in mechanical cooperation with the rear surface and is configured to substantially prevent the product supported by the bottom surface from movement relative to the bottom surface upon movement of the product display shelf.

10 Claims, 6 Drawing Sheets

PRODUCT DISPLAY SHELF WITH COMPLIANT MEMBER

CROSS-REFERENCE TO RELATED APPLICATION

The present application claims the benefits of and priority to U.S. Provisional Application Ser. No. 60/925,406, filed on Apr. 20, 2007, the entire contents of which being incorporated herein by reference.

BACKGROUND

The present disclosure relates generally to product displays used on a door. More particularly, the present disclosure relates to a product display shelf for use on a door and includes a member for stabilizing products on the product display shelf.

Shelves that are attachable to an interior of a door (e.g., a glass refrigerator or freezer door) are known in the art. An example of such a shelf is one that can be attached to the door using suction cups. In use, when shelves are attached to the interior of a door, the opening and closing of the door (e.g., by a customer) may cause products displayed on the shelf to move with respect to the shelf. For example, products may move back-and-forth, side-to-side, and may even fall off the shelf.

SUMMARY

The present disclosure relates to a product display shelf comprising a bottom surface, a rear surface and at least one compliant member. The bottom surface is configured to support at least one product thereon. The rear surface extends upwardly from the bottom surface. The at least one compliant member is disposed in mechanical cooperation with the rear surface and is configured to substantially prevent the product supported by the bottom surface from movement relative to the bottom surface upon movement of the product display shelf.

The present disclosure also relates to a method of displaying products. The method includes the step of providing a product display shelf including a bottom surface, a rear surface and at least one compliant member. The rear surface extends upwardly from the bottom surface. The at least one compliant member is disposed in mechanical cooperation with the rear surface and is configured to substantially prevent a product from movement relative to the bottom surface upon movement of the product display shelf. The method also includes the steps of removably securing the product display shelf to a vertical surface and positioning a product on the bottom surface such that a proximal portion of the product is in contact with the vertical surface while at least a distal portion of the product is in contact with the compliant member.

BRIEF DESCRIPTION OF FIGURES

Various embodiments of the presently disclosed product display shelf with compliant member are disclosed herein with reference to the drawings, wherein.

DETAILED DESCRIPTION

Figure 1:
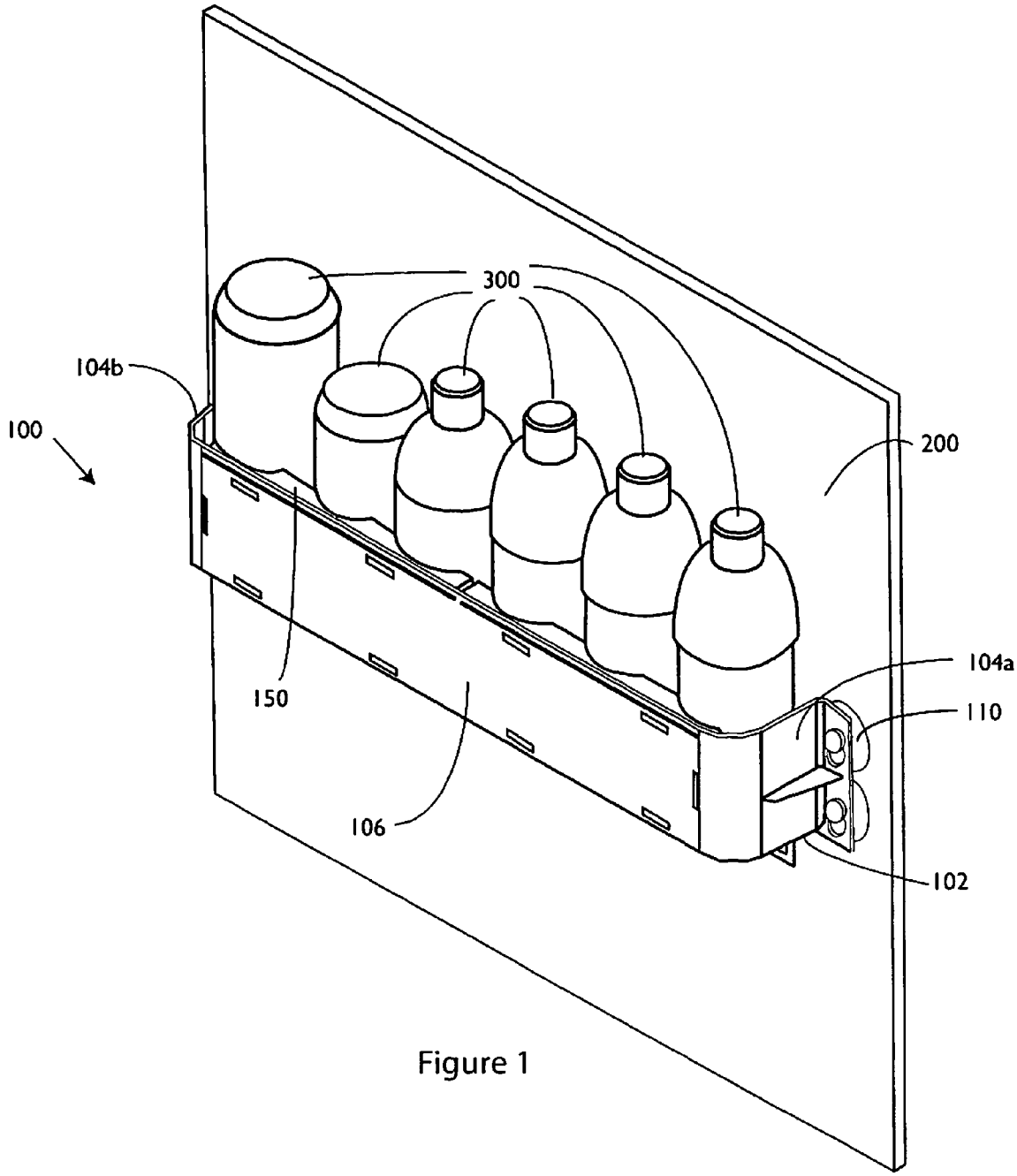
FIG. 1 is a perspective view of a product display shelf having a compliant member, in accordance with an embodiment of the present disclosure.
Figure 2:
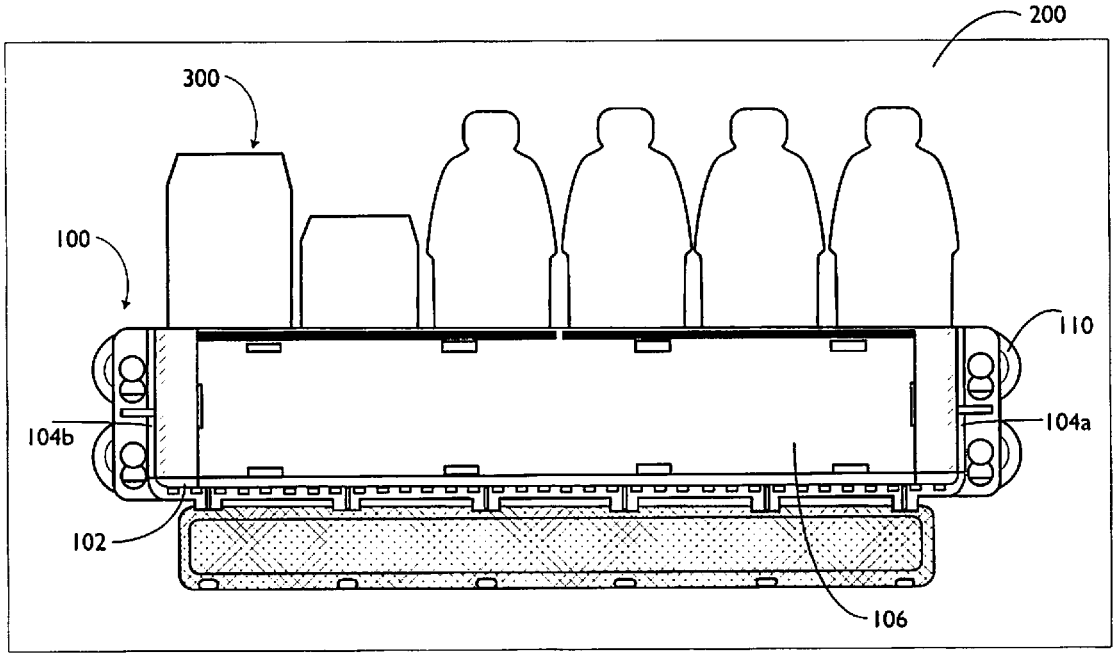
FIG. 2 is a front view of the product display shelf of FIG. 1.
Figure 3:
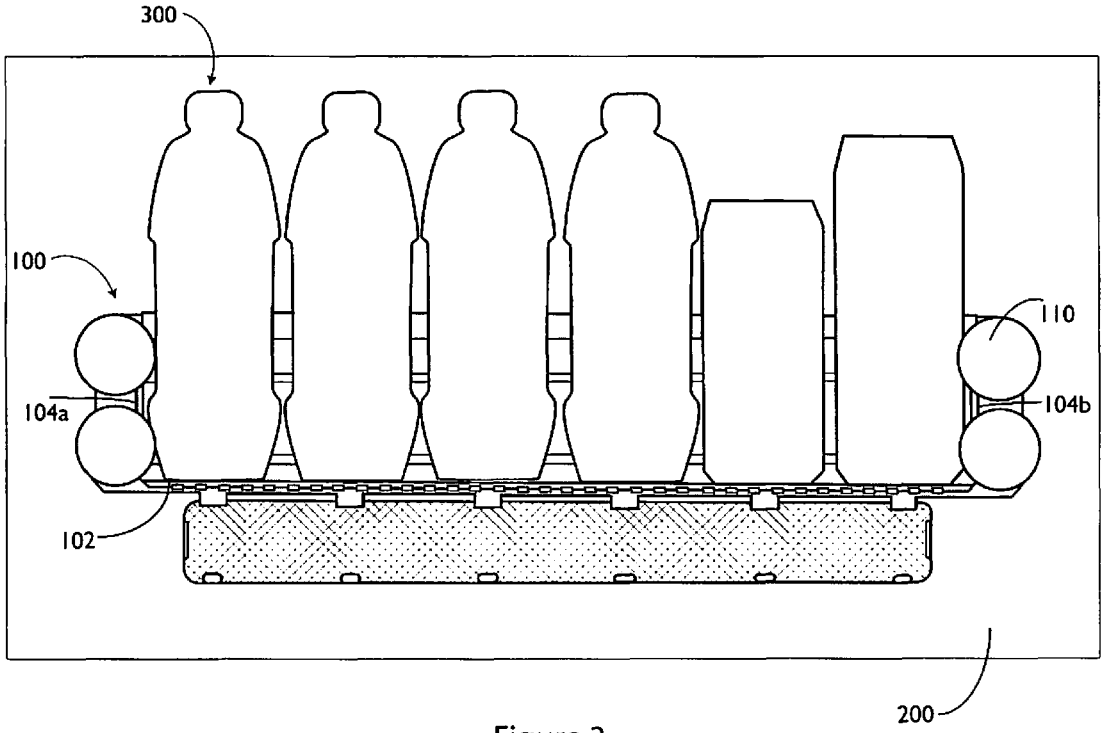
FIG. 3 is a rear view of the product display shelf of FIGS. 1 and 2.
Figure 4:
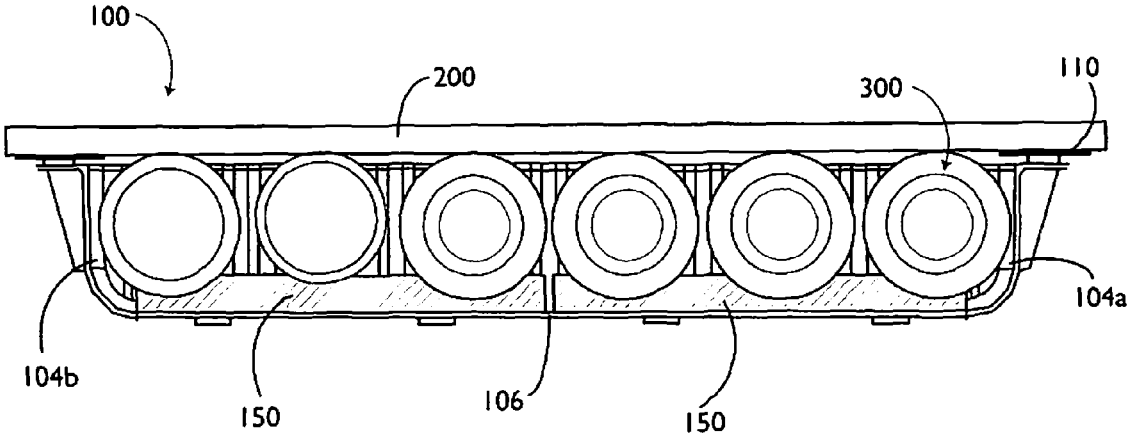
FIG. 4 is a top view of the product display shelf of FIGS. 1-3.

Embodiments of the presently disclosed product display shelf are described in detail with reference to the drawings wherein like numerals designate identical or corresponding elements in each of the several views. As is common in the art, the term "proximal" refers to that part or component closer to the user, e.g., customer, while the term "distal" refers to that part or component farther away from the user.

In combination with the accompanying FIGS. 1-6, a product display shelf 100 of the present disclosure is described herein. In the illustrated embodiments, shelf 100 is configured to be removably attached to a vertical surface 200 (e.g., a glass refrigerator or freezer door) by a securing structure 110 (e.g., at least one suction cup). Shelf 100 includes a bottom surface 102, two sides 104*a*, 104*b*, a rear surface 106, and a substantially open front (proximal portion), which faces vertical surface 200. The front of shelf 100 is substantially open to allow consumers to view products 300 disposed on shelf 100 (e.g., through a glass refrigerator or freezer door).

Shelf 100 also includes at least one flexible compliant member 150 in mechanical cooperation therewith. Compliant member 150 is configured to be secured (e.g., removably secured) to a portion of shelf 100 (e.g., rear surface 106) and to come into contact with a product 300 on shelf 100. It is envisioned that compliant member 150 substantially prevents products 300 that are on shelf 100 from movement relative to bottom surface 102 upon movement of product display shelf 10 (e.g., when door 200 is opened and/or closed by a customer). That is, with particular reference to FIG. 4, compliant member 150 (or more than one compliant member 150) at least partially fills the otherwise empty space between an individual product 300 and rear surface 106 of shelf 100. With continued reference to FIG. 4, compliant member 150 also allows securely positioning products 300 of different sizes (e.g., different transverse cross-sections) on shelf 100 such that the products 100 are substantially free from movement relative to bottom surface 102 upon movement of shelf 100 (e.g., upon the opening of refrigerator or freezer door).

Due at least in part to its flexibility, compliant member 150 substantially conforms to the shape of a portion of product 300 and puts pressure on product 300 in a proximal direction (i.e., towards vertical surface 200). Thus, products 300 are snuggly held between compliant member 150 and door 200. Accordingly, the use of compliant member 150 with shelf 100 helps prevent products 300 on shelf 100 from undergoing substantial movement when vertical surface 200 is moved (e.g., door is opened and/or closed).

Figure 5:
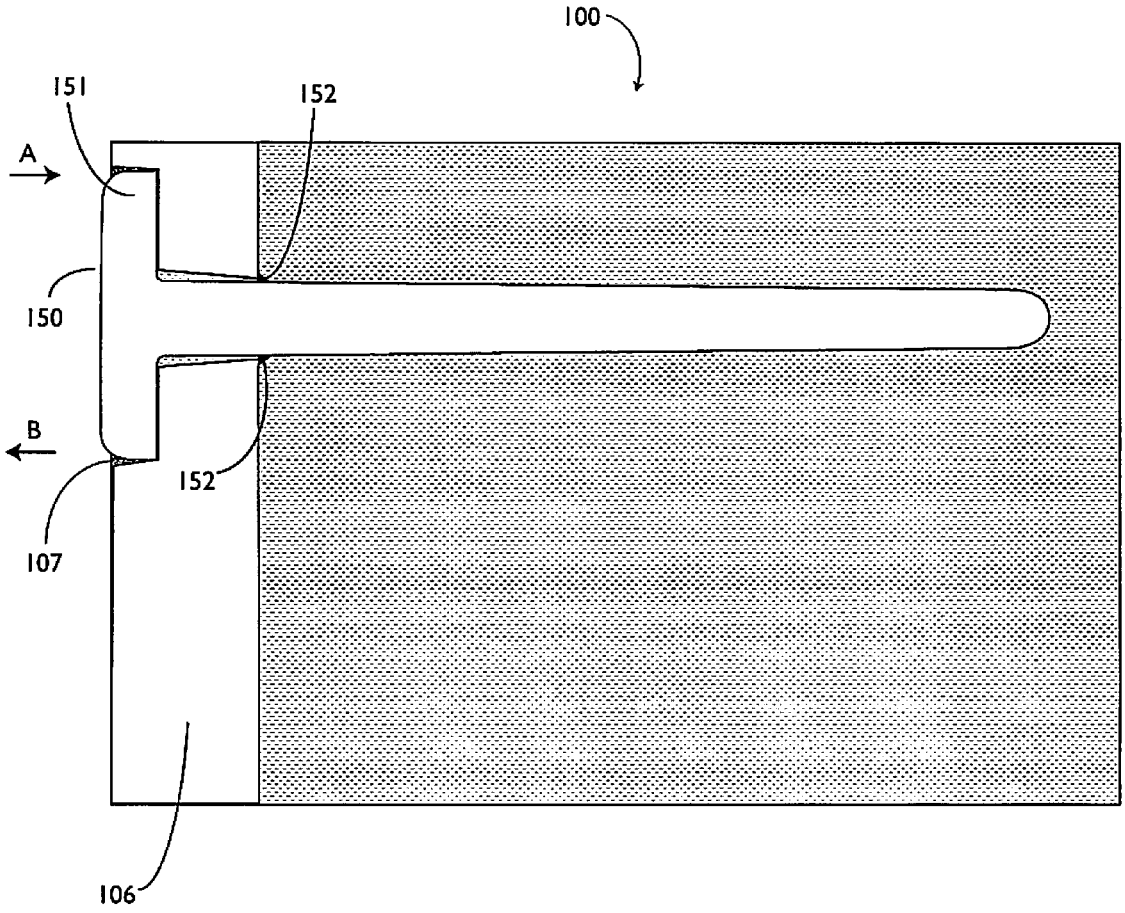
FIG. 5 is a transverse cross-sectional view of an embodiment of a compliant member inserted through a portion of the product display shelf of FIGS. 1-4.
Figure 6:
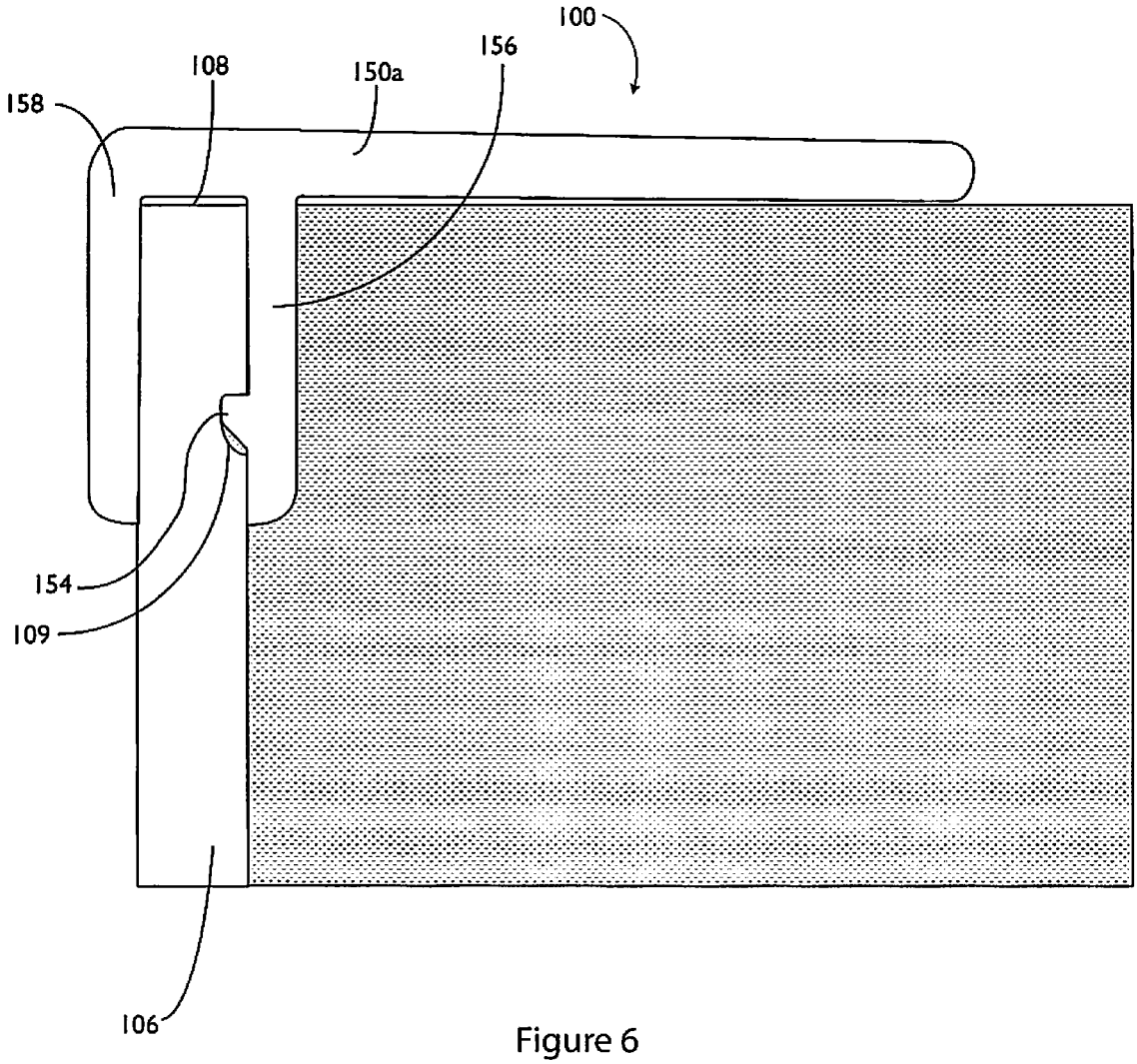
FIG. 6 is a transverse cross-sectional view of another embodiment of a compliant member placed over a portion of the product display shelf of FIGS. 1-4.

With reference to FIGS. 5 and 6, compliant member 150 may be installed on shelf 100 in a variety of ways. For example, in FIG. 5 (illustrating a transverse cross-sectional view of compliant member 150 through rear portion 106 of shelf 100), compliant member 150 is installed by inserting compliant member 150 through an opening 107 (e.g., a longitudinal slot) in rear portion 106 of shelf 100 in a proximal direction (arrow "A"). Further, compliant member 150 is illustrated having protrusions 152 which help prevent unintentional ejection of compliant member 150 in a distal direction (arrow "B"). As illustrated in FIG. 5, a distal portion 151 of compliant member 150 is larger than at least a portion of opening 107, such that compliant member 150 is prevented from being inserted entirely through rear portion 106. Additionally, FIG. 5 illustrates opening 107 in rear portion 106 being configured to allow at least a portion of distal portion 151 of compliant member 150 to be at least partially recessed within rear portion 106.

In FIG. 6, another embodiment of a compliant member is illustrated and is referred to as reference numeral 150*a*. Compliant member 150*a* is configured to be placed over an edge 108 of rear portion 106 of shelf 100. Here, compliant member 150*a* includes a first leg 156 and a second leg 158. As shown, first leg 156 contacts a proximal side of rear portion 106 and second leg 158 contacts a distal side of rear portion 106. As can be appreciated, compliant member 150*a* of this embodiment can be used in conjunction with a conventional, non-modified product display shelf.

Additionally, first leg 156 of compliant member 150*a* is shown including a lip 154 for mechanically engaging a notch 109 on the proximal side of rear portion 106 of shelf 100 to help secure compliant member 150 thereon. It is also envisioned that lip 154 may alternatively or additionally be included on the distal side of rear portion 106 to engage a notch on the distal side (not shown) of rear portion 106.

As can be appreciated, the configurations of compliant members 150, 150*a* allow for removal and interchangeability. For instance, if compliant member 150, 150*a* becomes damaged or soiled, a user can remove old compliant member 150, 150*a* and insert a new compliant member 150, 150*a* in its place.

It is envisioned that at least a portion of compliant member 150, 150*a* (e.g., the proximally extending elongated portion) may be made of a flexible polyvinyl chloride (PVC) material, a plurality of bristles, another suitable material, and/or any combinations thereof. Additionally, the different portions of compliant member 150, 150*a* may be made of different materials from one another, or alternatively, compliant member 150 150*a* may be monolithically formed.

In embodiments of the present disclosure, compliant member 150, 150*a*, may include a rigid portion or may be entirely rigid (or substantially rigid). That is, compliant member 150, 150*a* may be configured for use with a particular shelf 100 (e.g., based on a width of its bottom surface 102) and a particular product 300. For instance, it is envisioned that a product-contacting portion of compliant member 150, 150*a* may include a series of concavities, where each concavity is configured for securing a specific product (e.g., a beverage can, a beverage bottle, a one liter bottle, a two liter bottle, etc.) having any regular or irregular shape with respect to product display shelf 100.

While several embodiments of the disclosure have been shown in the figures, it is not intended that the disclosure be limited thereto, as it is intended that the disclosure be as broad in scope as the art will allow and that the specification be read likewise. Therefore, the above description should not be construed as limiting, but merely as exemplifications of various embodiments. Those skilled in the art will envision other modifications within the scope and spirit of this disclosure.

The invention claimed is:

1. A method of displaying products, comprising the steps of:

providing a product display shelf, comprising:

a bottom surface;

a rear surface extending upwardly from the bottom surface; and at least one compliant member disposed in mechanical cooperation with the rear surface and configured to substantially prevent a product from movement relative to the bottom surface upon movement of the product display shelf;

removably securing the product display shelf to a vertical surface;

positioning a product on the bottom surface such that a proximal portion of the product is in contact with the vertical surface while at least a distal portion of the product is in contact with the compliant member;

wherein the compliant member has a length, a distal portion of the compliant member being in substantial contact with the rear surface along a majority of the length of the compliant member.

2. The method of claim 1, wherein the compliant member is configured to substantially conform to a surface of the product.

3. The method of claim 1, wherein the compliant member is at least partially made from a flexible polyvinyl chloride material.

4. The method of claim 1, wherein the compliant member is configured to simultaneously substantially conform to at least two products having different transverse cross-sections.

5. The method of claim 1, wherein the compliant member is insertable through an opening in the rear surface.

6. The method of claim 5, wherein the compliant member includes at least one protrusion extending therefrom, the protrusion being configured to help maintain the position of the compliant member with respect to the rear surface.

7. The method of claim 1, wherein the compliant member is positionable over an upper edge of rear surface.

8. The method of claim 7, wherein a transverse cross-section of the product includes a curve.

9. The method of claim 1, further comprising a securing structure disposed in mechanical cooperation with a portion of the shelf, the securing structure configured to removable secure the product display shelf to a vertical surface.

10. The method of claim 9, wherein the securing structure includes at least one suction cup.

* * * * *